US008808523B2

(12) United States Patent
Lu et al.

(10) Patent No.: US 8,808,523 B2
(45) Date of Patent: Aug. 19, 2014

(54) METHOD FOR FORMING ZRO2 FILM BY PLASMA ELECTROLYTIC OXIDATION

(71) Applicant: National Chung Hsing University, Taichung (TW)

(72) Inventors: Fu-Hsing Lu, Taichung (TW); Jhu-Ling Zeng, Tainan (TW); Huan-Ping Teng, Kaohsiung (TW)

(73) Assignee: National Chung Hsing University, Taichung (TW)

( * ) Notice: Subject to any disclaimer, the term of this patent is extended or adjusted under 35 U.S.C. 154(b) by 0 days.

(21) Appl. No.: 13/954,391

(22) Filed: Jul. 30, 2013

(65) Prior Publication Data

US 2013/0306487 A1 Nov. 21, 2013

Related U.S. Application Data

(62) Division of application No. 13/227,277, filed on Sep. 7, 2011.

(51) Int. Cl.

| | |
|---|---|
| ***C23C 28/04*** | (2006.01) |
| ***C25D 11/02*** | (2006.01) |
| ***C25D 11/26*** | (2006.01) |
| ***C25D 11/16*** | (2006.01) |
| ***C25D 9/04*** | (2006.01) |

(52) U.S. Cl.

CPC ..... *C25D 9/04* (2013.01); *C23C 28/042* (2013.01); *C25D 11/16* (2013.01); *C25D 11/026* (2013.01); *C25D 11/26* (2013.01)

USPC ..... 205/107; 205/108; 205/188; 205/189; 205/322; 205/333

(58) Field of Classification Search

USPC ..... 205/188, 189, 322, 333

See application file for complete search history.

(56) References Cited

U.S. PATENT DOCUMENTS 3,869,367 A 3/1975 Sato et al.
5,427,678 A 6/1995 Yoshimura et al.

(Continued)

FOREIGN PATENT DOCUMENTS

WO WO 2010/112914 10/2010

OTHER PUBLICATIONS

V. D. Jovic et al. "Properties of ZrO2 Passive Film Formed onto Zr Electrode in 1 M NaOH at Low Voltage", Journal of the Electrochemical Society, 155 (5), C183-C188 (2008).*

S. Venigalla, et al.. "Low temperature electrochemical synthesis and dielectric characterization of barium titanate films using nonalkali electrolytes", J. Electrochem. Soc., vol. 142, No. 6, Jun. 1995, pp. 2101-2019.

(Continued)

*Primary Examiner* — James Lin
*Assistant Examiner* — William Leader
(74) *Attorney, Agent, or Firm* — Muncy, Geissler, Olds & Lowe, P.C.

(57) ABSTRACT

A method for forming a $ZrO_2$ oxide film by plasma electrolytic oxidation includes a first step of placing an anode, which is a substrate with a ZrN film, and a cathode into an electrolyte of which the temperature range is from 65° C. to 75° C. Said electrolyte contains barium acetate or barium hydroxide ranging from 0.3 M to 0.7 M and sodium hydroxide or potassium hydroxide ranging from 1.5 M to 2.5 M. The method includes a second step of applying a voltage ranging from 50 V to 1000 V to the anode and cathode to finally form a $ZrO_2$ film on a surface of the ZrN film of the anode. A DC power supply, an AC power supply, unipolar pulse power supply or bipolar pulse power supply is applied to said anode and cathode in constant-voltage mode or constant-current mode. The oxide film can be formed more rapidly than the prior art and has excellent crystallinity.

4 Claims, 7 Drawing Sheets

(56) References Cited

U.S. PATENT DOCUMENTS

| | | | | |
|---|---|---|---|---|
| 5,800,693 | A | 9/1998 | Kakizaki et al. | |
| 6,245,436 | B1 | 6/2001 | Boyle et al. | |
| 7,077,943 | B2 * | 7/2006 | Lu et al. | 205/189 |
| 2003/0070935 | A1 | 4/2003 | Dolan | |
| 2006/0016690 | A1 | 1/2006 | Ostrovsky | |
| 2009/0035213 | A1 | 2/2009 | Takayasu et al. | |
| 2010/0131052 | A1 | 5/2010 | Kappelt et al. | |

OTHER PUBLICATIONS

Pei-Hsuan Chan and Fu-Hsing, "Low temperature hydrothermal synthesis and the growth kinetics of BaTiO3 films on TiN/Si, Ti/Si, and bulk-Ti substrates", J. Electrochem. Soc., vol. 157, No. 6, 2010, pp. G130-G135.

* cited by examiner

METHOD FOR FORMING ZRO2 FILM BY PLASMA ELECTROLYTIC OXIDATION

CROSS-REFERENCE TO RELATED APPLICATIONS

This application is a Divisional of co-pending application Ser. No. 13/227,277, filed on Sep. 7, 2011, for which priority is claimed under 35 U.S.C. §120, the entire contents of all of which are hereby incorporated by reference.

BACKGROUND OF THE INVENTION

1. Field of the Invention

The present invention relates generally to a method for forming an oxide film and more particularly, to a method for forming an oxide film onto conductivity nitride film within a short electrolytic duration.

2. Description of the Related Art

Various methods have been used to produce oxides, such as barium titanate ($BaTiO_3$), or ceramic material and mainly include processes of sol-gel, physical vapor deposition (PVD), radio frequency sputtering (RF), chemical vapor deposition (CVD), electrochemical, hydrothermal, hydrothermal electrochemical, and plasma electrolytic oxidation (PEO). Among them, plasma electrolytic oxidation process is superior to the other processes, having more advantages, greater adhesion between the produced oxide and the substrate, and better crystallinity of the produced oxide.

A metal bulk or metal film substrate must be used in the traditional PEO, and however the growth rate of the oxide is lower.

SUMMARY OF THE INVENTION

The present invention has been accomplished in view of the above-noted circumstances. It is therefore one objective of the present invention to provide a method for forming an oxide film by PEO that can produce an oxide film rapidly, which has excellent crystallinity.

To achieve the above-mentioned objective, the method for forming an oxide film by PEO of the present invention includes the steps of (a) placing an anode, which is a substrate with a conductive nitride film, and a cathode into an electrolyte of which the temperature range is from 20° C. to 100° C., and (b) applying a voltage ranging from 50 V (volts) to 1000 V to the anode and cathode to therefore form an oxide film on the surface of the conductive nitride film of the anode. Because a substrate with conductive nitride film has higher melting point and capable of bearing high temperature for the duration of PEO, the oxide film can be formed rapidly on the surface thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

A method for forming an oxide film by PEO according to the present invention is placing an anode and a cathode into an electrolyte first, and then applying a voltage to the anode and cathode so as to form an oxide film on the surface of the anode.

The anode is a substrate covered with a conductive nitride film thereon. The material of the substrate may be silicon (Si) wafer, glass, metal, ceramic or polymer. The conductive nitride film may be titanium nitride (TiN) film, zirconium nitride (ZrN) film, chromium nitride (CrN) film, hafnium nitride (HfN) film, tungsten nitride (WN) film, or tantalum nitride (TaN) film. The cathode may be platinum electrode, carbon electrode, stainless steel electrode or other suitable electrode. The electrolyte may contain barium hydroxide ($Ba(OH)_2$) or barium acetate ($Ba(CH_3COO_2)$) ranging from 0.3 M to 0.7 M and potassium hydroxide (KOH) or sodium hydroxide (NaOH) ranging from 1.5 M to 2.5 M, and have temperature preferably ranging from 20° C. to 100° C.

In addition, the way to apply voltage may be constant-voltage mode or constant-current mode. The voltage applied to the anode and cathode preferably ranges from 50 V to 1000 V. The power supply may be direct-current (DC) power supply, unipolar pulse power supply, bipolar pulse power supply or alternating-current (AC) power supply.

Figure 1:
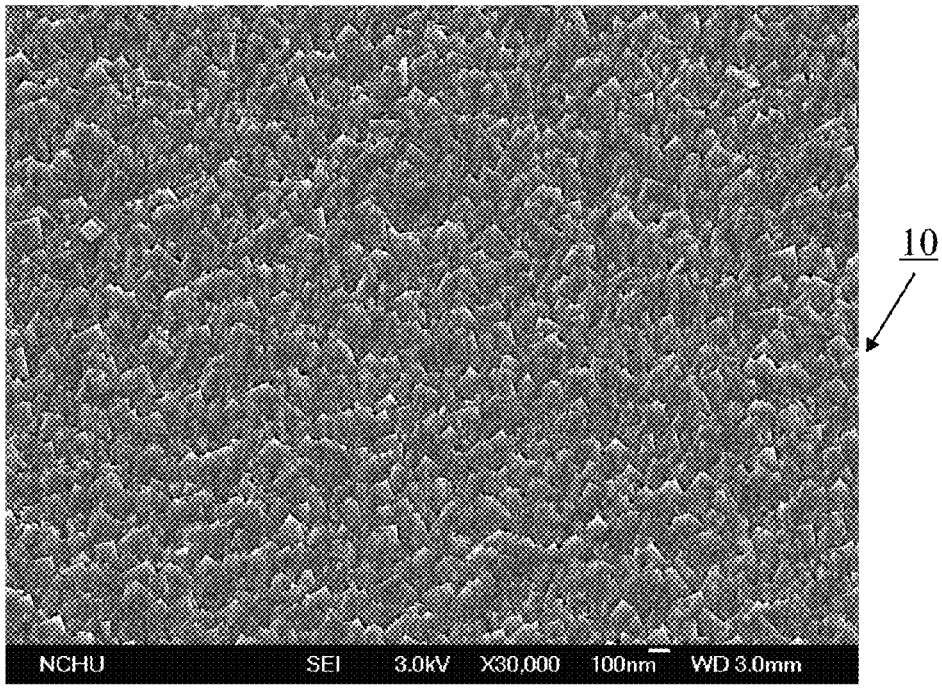
FIG. 1 is a field emission scanning electron microscope (FE-SEM) microphotograph of a surface of an anode before PEO according to a first embodiment of the present invention.
Figure 2:
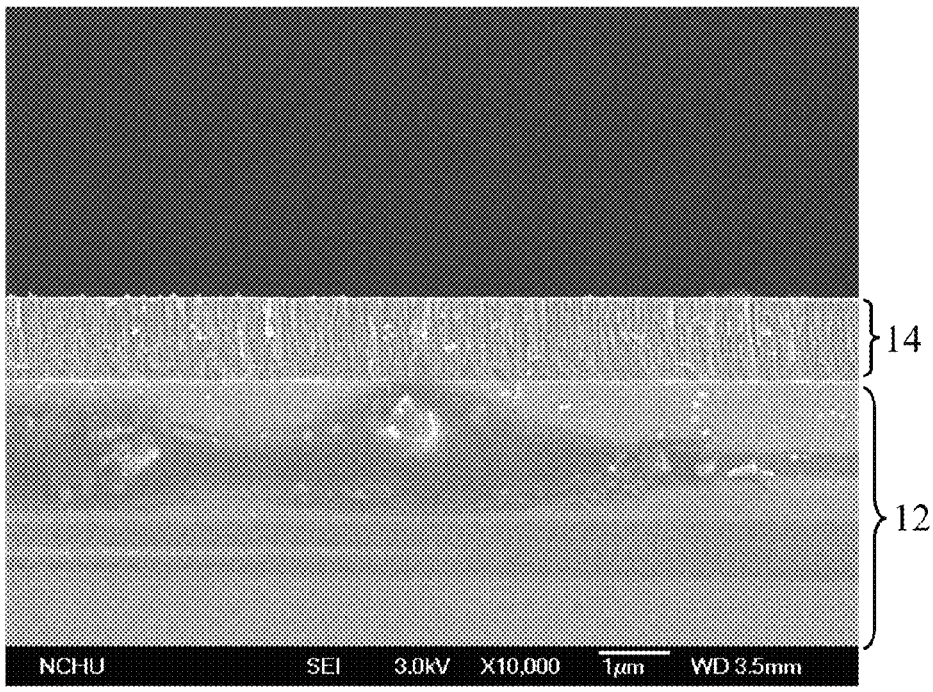
FIG. 2 is an FE-SEM microphotograph of the cross-sectional view of the anode in FIG. 1.
Figure 3:
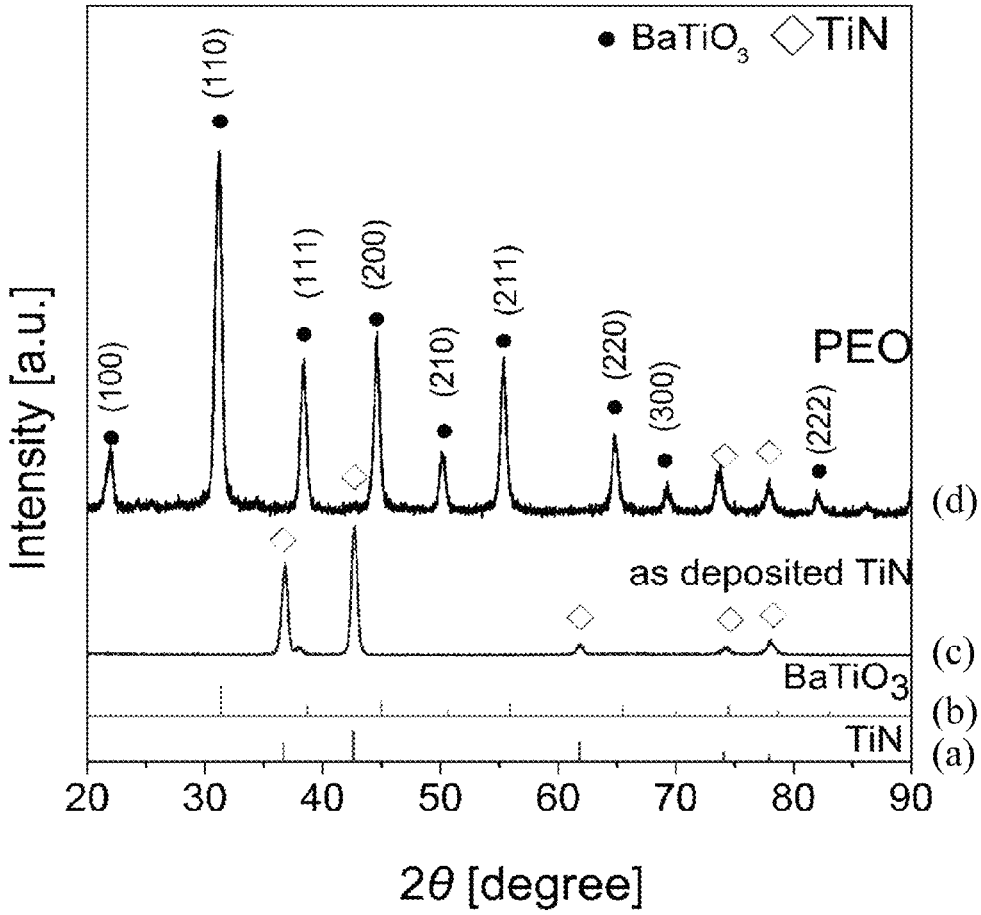
FIG. 3 shows an X-ray diffraction (XRD) spectrum of the anode after PEO according to the first embodiment.
Figure 6:
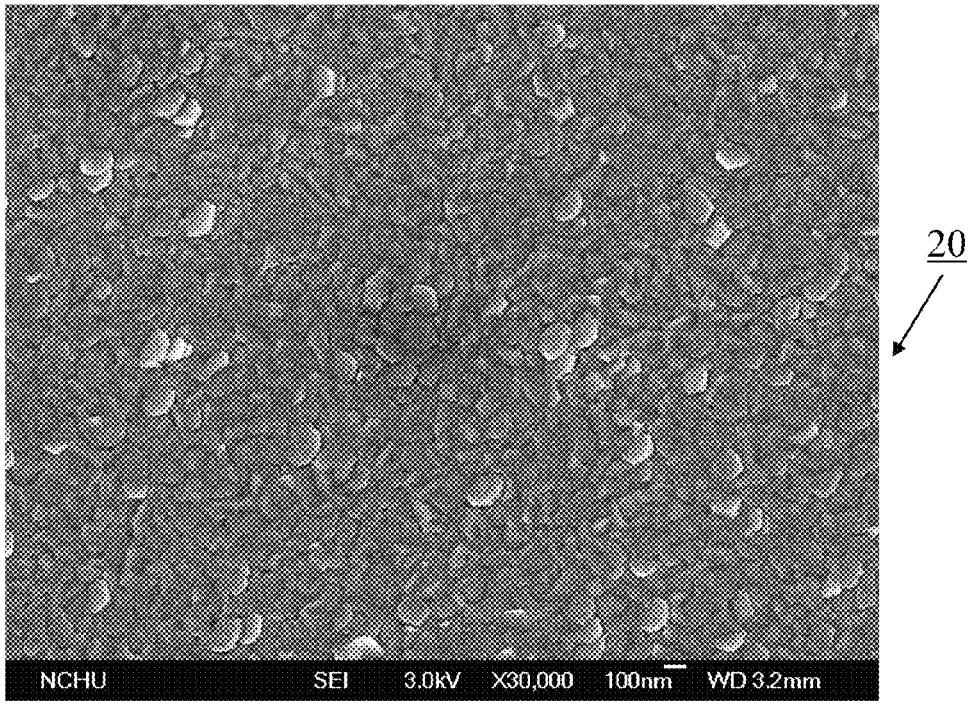
FIG. 6 is an FE-SEM microphotograph of an anode before PEO according to a comparative embodiment.
Figure 7:
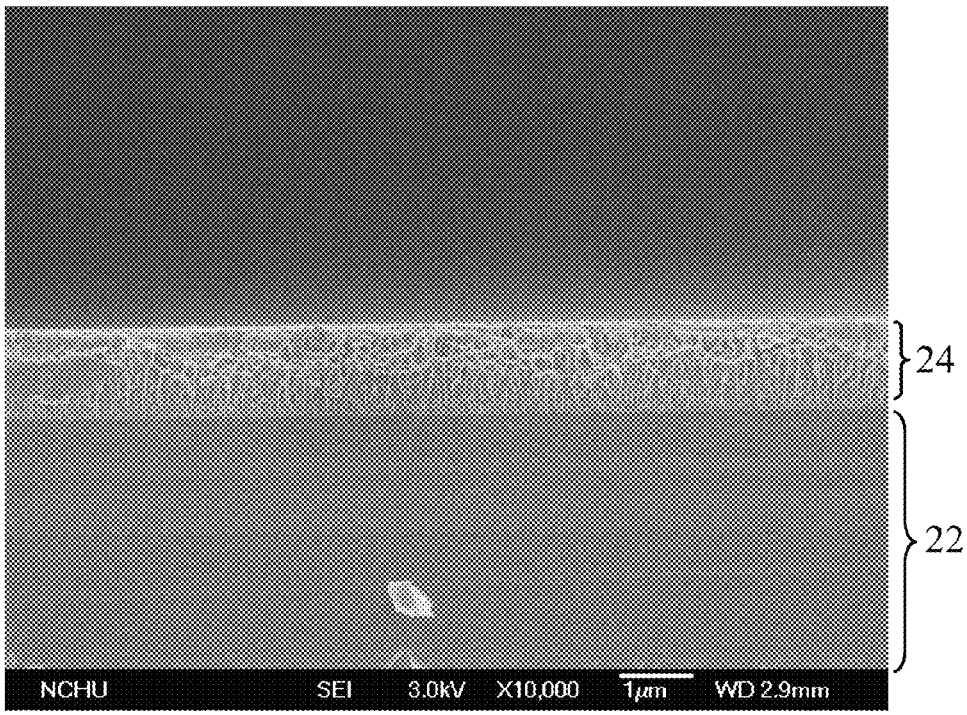
FIG. 7 is an FE-SEM microphotograph of the cross-sectional view of the anode in FIG. 6.
Figure 8:
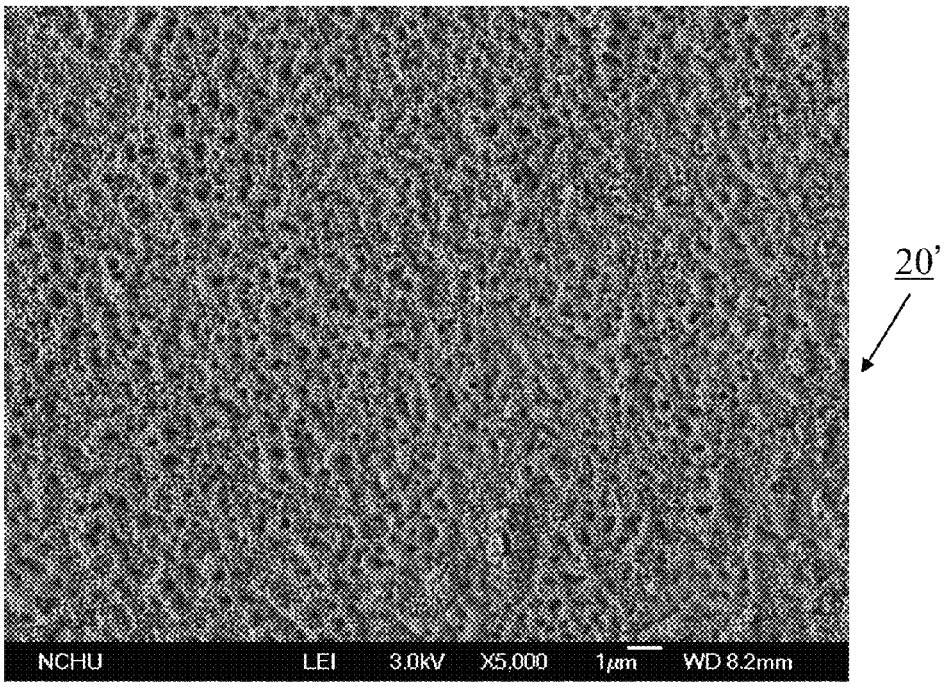
FIG. 8 is an FE-SEM microphotograph of the oxide film formed on the surface of the anode after PEO according to the comparative embodiment.
Figure 9:
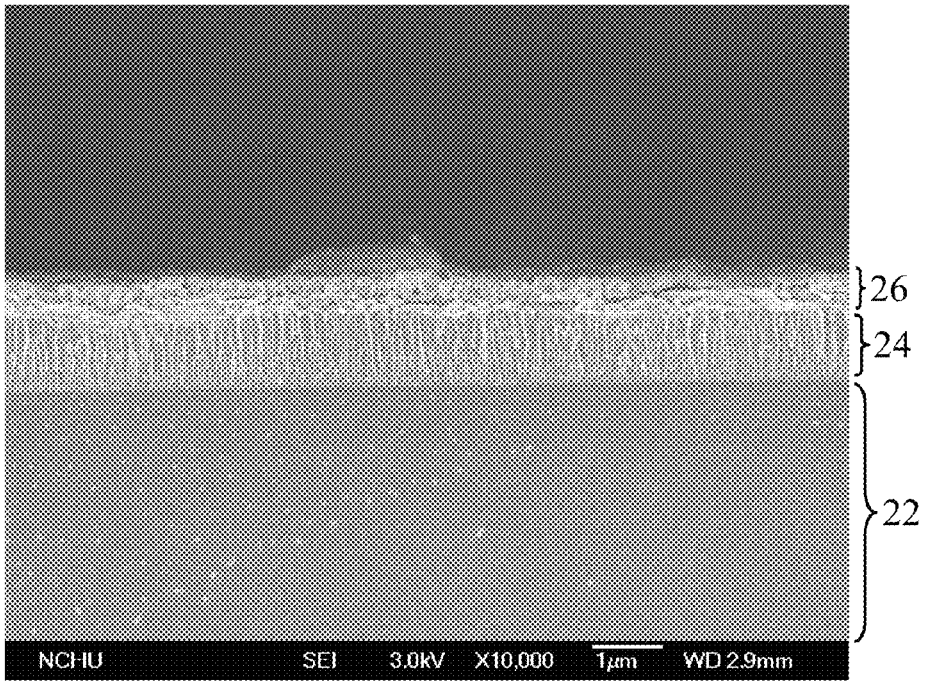
FIG. 9 is an FE-SEM microphotograph of the cross-sectional view of the anode in FIG. 8.

FIGS. 1 and 2 illustrate the surface and cross-section of an anode 10 according to a first embodiment, and FIGS. 6 and 7 illustrate the surface and cross-section of an anode 20 according to a comparative embodiment. A titanium nitride film 14 and a titanium film 24 were deposited on N type (100) silicon wafers 12, 22 respectively by, not limited to, DC magnetron sputtering in accordance with the parameters shown in the following Table 1, so as to manufacture the anode 10 of the first embodiment and the anode 20 of the comparative embodiment. The conductive nitride film and the metal film may be formed on the substrates by way of sintering, spray coating, dipping, or adhering. In a word, the anode 10 is manufactured by way of forming a conductive nitride film on a substrate, whereas the anode 20 was manufactured by way of forming a metal film on a substrate as disclosed in the prior art. The pattern (c) in FIG. 3 is the XRD spectrum of the surface of the anode 10 according to the first embodiment. The pattern (c) in FIG. 3 is compared with the standard TIN pattern (a) in FIG. 3, which is the JCPDS card number 38-1420, to confirm that the TiN film 14 is deposited on the surface of the silicon wafer 20.

TABLE 1

| | |
|---|---|
| Substrate | Silicon Wafer |
| Material of Target | Titanium (99.995%) |
| DC Power | 400 Watts |
| Injected Gas | $AR/N_2$ (16/4.65) |
| Working Pressure | $1.0 \times 10^{-3}$ Torr |
| Deposition Temperature | Room Temperature |

After the anodes 10, 20 were manufactured, the PEOs were conducted under the conditions that the reactive area of the anodes 10, 20 were about 1.7 $cm^2$, the cathode was platinum sheet, the electrolyte was a mixture of 0.5 M barium acetate ($Ba(CH_3COO_2)$) and 2 M sodium hydroxide (NaOH) in deionized water, the temperature was maintained at 70° C., the voltage of the DC power supply was set at 70 V, and the reaction times of the first embodiment and the comparative embodiment were one minute and three minutes respectively, resulting in that oxide films were formed on the surfaces of anodes 10, 20 to obtain the anodes 10', 20'.

The anodes 10', 20' thus obtained were treated according to the following steps of washing them by alcohol and deionized water, immersing them in dilute phosphoric acid, washing them by deionized water again, and naturally drying them in the air. An FE-SEM (Model No.: JSM6700F, JEOL, Japan) is used to observe the surfaces and cross-sections of the anodes 10', 20'. Further, the crystalline phase of the surfaces of the anodes 10', 20' were analyzed by an XRD (Model No.: MXP3, MacScience, Japan) equipped with a copper target ($\lambda_{Cuk\alpha}$=0.157 nm) and operated at 40 kV and 30 mA.

Figure 4:
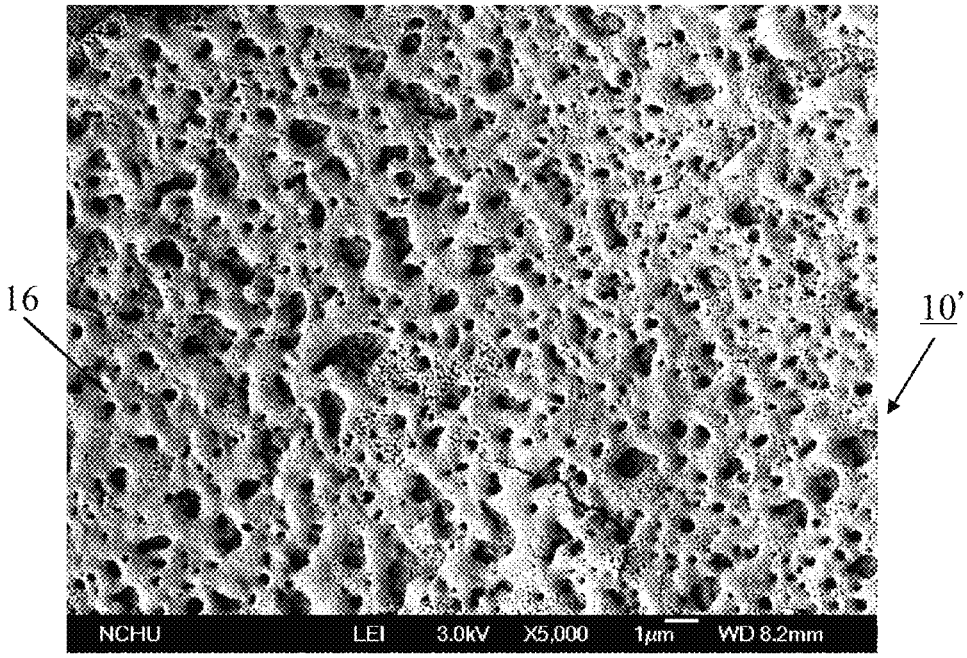
FIG. 4 is an FE-SEM microphotograph of the oxide film formed on the surface of the anode after PEO.
Figure 5:
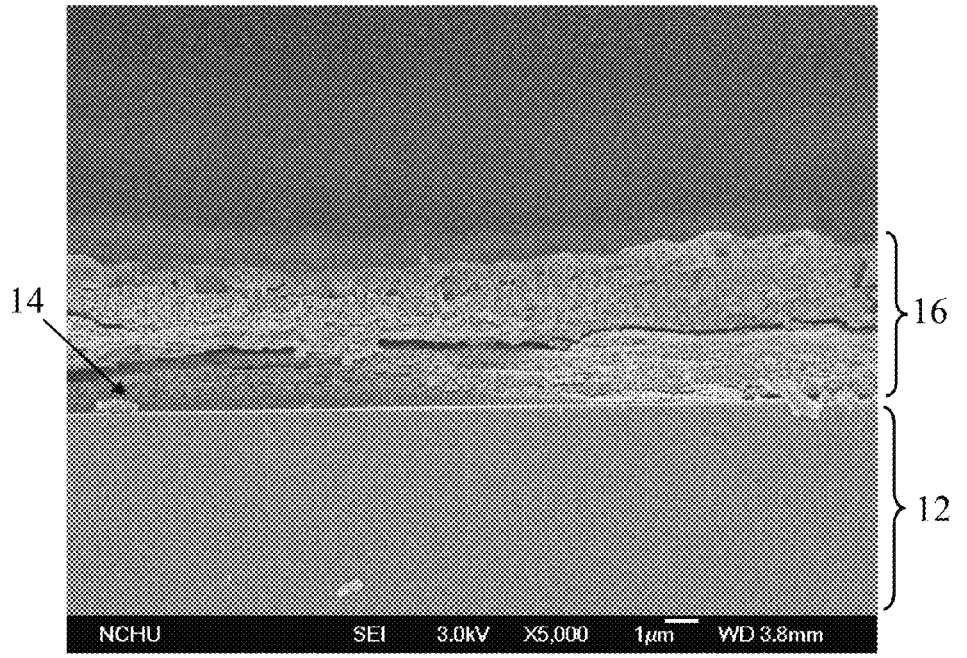
FIG. 5 is an FE-SEM microphotograph of the cross-sectional view of the anode in FIG. 4.

Compared with FIGS. 2 and 5, it can be observed that the thickness of the titanium nitride film 14 deposited on the surface of the silicon wafer 12 is reduced significantly after the PEO was completed, indicating that most of the titanium nitride film 14 has reacted with the barium ion in the electrolyte and has oxidized to form barium titanate film 16. The pattern (d) shown in FIG. 3 is the XRD spectrum of the surface of the anode 10'. Compared with the pattern (d), the aforesaid aid standard TiN pattern (a), and the standard $BaTiO_3$ pattern (b), which is the JCPDS card number 31-0174, shown in FIG. 3, it can observed that the diffraction peak intensity of titanium nitride decreases significantly and the diffraction peaks of barium titanate appear, indicating that the most of the titanium nitride has been transformed to barium titanate. Consequently, the aforesaid results confirm that the barium titanate ($BaTiO_3$) film 16 is formed on the surface of the anode 10'. In addition, as shown in FIGS. 4-5, the barium titanate film 16 on the anode 10' has uniform porous structure and its thickness is about 4.74 μm. Although the barium titanate film 26 formed on the anode 20' according to the comparative embodiment has porous structure, its pores are smaller and it has a thickness of about 0.53 μm only.

As stated above, the barium titanate film with a thickness of 0.53 μm only is formed within three minutes according to the conventional method in which the anode is a substrate deposited with a metal film, whereas the barium titanate film with a thickness of 4.74 μm is formed within one minute according to the present invention in which the anode is a substrate deposited with a conductive nitride film. Therefore, an oxide film can be formed more rapidly on the surface of the substrate by the present invention.

According to the second embodiment of the present invention, a zirconium oxide ($ZrO_2$) film is produced by PEO.

Figure 10:
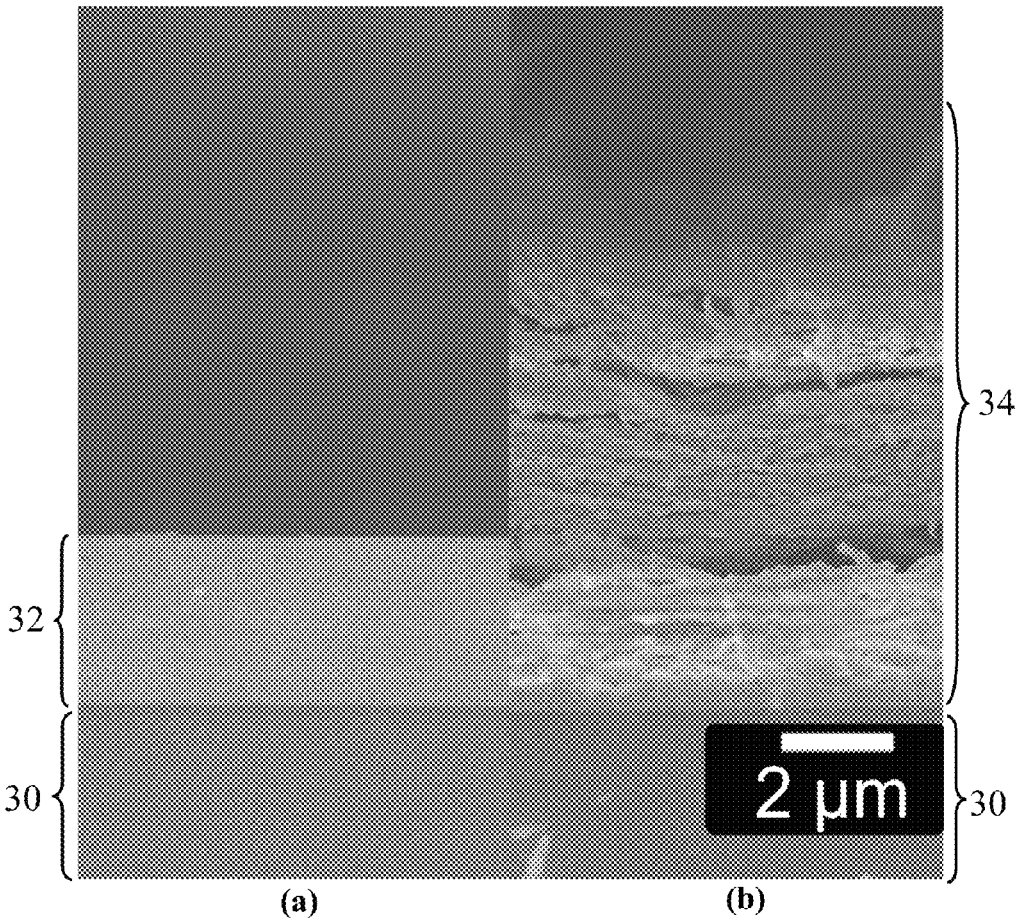
FIG. 10 are FE-SEM microphotographs of cross-sectional views of anodes before and after PEO respectively according to a second embodiment.

The main difference between the second embodiment and the first embodiment lies in that a zirconium nitride film 32 is deposited on the surface of a silicon (Si) wafer 30 by DC magnetron sputtering in accordance with the parameters shown in the Table 1, so as to manufacture the ZrN/Si anode as shown in the microphotograph (a) of FIG. 10.

The conditions of PEO, including the reactive area of the ZrN/Si anode, the material of the cathode, the kind of the electrolyte, the temperature, and the voltage were the same as those of the first embodiment, except that the reaction time of the second embodiment was three minutes, resulting in that the anode as shown in the microphotograph (b) of FIG. 10 was manufactured.

Figure 11:
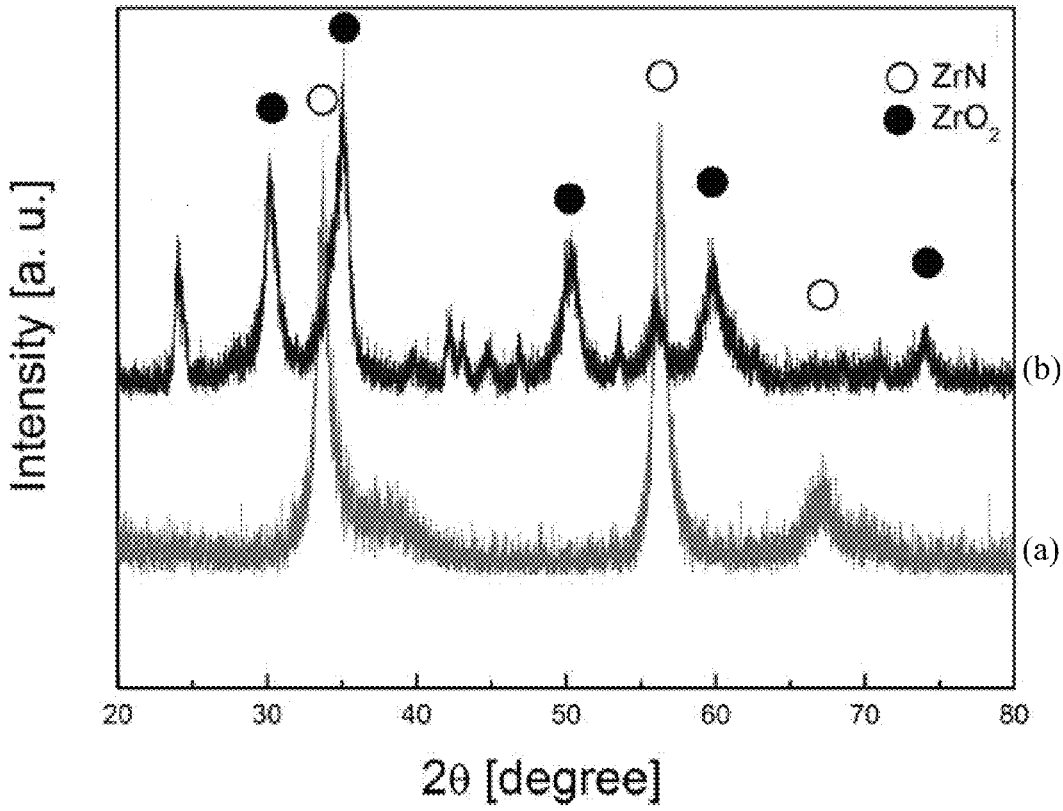
FIG. 11 shows an XRD spectrum of the anode after PEO according to the second embodiment.

Compared with the microphotographs (a) and (b) of FIG. 10, it can observed that the zirconium nitride film 32 deposited on the surface of the silicon wafer 30 was almost disappeared after the PEO was completed, indicating that the zirconium nitride film 32 has almost reacted with the electrolyte and has oxidized to form zirconium oxide film 34. In addition, the pattern (b) in FIG. 11, which is the XRD spectrum of the surface of the anode after PEO, is compared with the pattern (a) of zirconium nitride. It can be observed that the diffraction peak intensity of zirconium nitride decreases significantly and the diffraction peaks of zirconium oxide appear, indicating that most of the zirconium nitride has been transformed into zirconium oxide. Consequently, the aforesaid results confirm that the zirconium oxide film can be effectively formed on the surface of a substrate deposited with a conductive nitride film. Further, the zirconium oxide film 34 has a thickness of 8.09 μm as shown in the microphotograph (b) of FIG. 10.

As mentioned above, the zirconium oxide film with a thickness of 8.09 μm is formed within three minutes according to the present invention in which the anode is a substrate deposited with a conductive nitride film. Therefore, an oxide film can be formed more rapidly on the surface of the substrate by the present invention.

In fact, the electrolyte used in the first and second embodiments is though a mixture containing 0.5 M barium acetate ($Ba(CH_3COO_2)$) and 2 M sodium hydroxide (NaOH), and the voltage of the direct current power supply is set for 70 V, the present invention is not limited thereto. A barium titanate film and a zirconium oxide film can be successfully produced under the conditions that the electrolyte contains barium acetate ranging from 0.3 M to 0.7 M and sodium hydroxide ranging from 1.5 M to 2.5 M, and a voltage ranging from 65 V to 75 V according to the actual results of tests.

The invention being thus described by the aforesaid embodiments, it will be obvious that the present invention is not limited to form barium titanate film or zirconium oxide film. It should be understood that various oxide film such as titanium dioxide ($TiO_2$) or aluminum oxide ($Al_2O_3$) can be formed in accordance with the conductive nitride film, the electrolyte, the temperature of the electrolyte and the voltage. Thus, such variations and modifications as would be obvious to one skilled in the art are intended to be included within the scope of the following claims.

What is claimed is:

1. A method for forming a $ZrO_2$ film by plasma electrolytic oxidation (PEO), comprising steps of:

(a) placing an anode, which is a substrate deposited with a ZrN film, and a cathode into an electrolyte of which the temperature range is from 65° C. to 75° C., wherein said electrolyte contains barium acetate or barium hydroxide ranging from 0.3 M to 0.7 M and sodium hydroxide or potassium hydroxide ranging from 1.5 M to 2.5 M; and (b) applying a voltage ranging from 50 V (volts) to 1000 V to said anode and cathode to form a $ZrO_2$ film on a surface of said ZrN film, wherein a DC power supply, an AC power supply, unipolar pulse power supply or bipolar pulse power supply is applied to said anode and cathode in constant-voltage mode or constant-current mode.

2. The method as claimed in claim 1, wherein said ZrN film is formed on said substrate by way of sputtering, sintering, spray coating or dipping in the step (a).

3. The method as claimed in claim 1, wherein said cathode is platinum, carbon, or stainless steel in the step (a).

4. The method as claimed in claim 1, wherein a DC voltage ranging from 65 V to 75 V is applied to said anode and cathode in the step (b).

* * * * *